US009670668B2

(12) United States Patent
Metten

(10) Patent No.: US 9,670,668 B2
(45) Date of Patent: Jun. 6, 2017

(54) MASONRY SYSTEM

(75) Inventor: Hans-Josef Metten, Bergisch Gladbach (DE)

(73) Assignee: METTEN Stein + Design GmbH & Co. KG, Overath (DE)

( * ) Notice: Subject to any disclaimer, the term of this patent is extended or adjusted under 35 U.S.C. 154(b) by 1169 days.

(21) Appl. No.: 13/097,177

(22) Filed: Apr. 29, 2011

(65) Prior Publication Data

US 2011/0203211 A1 Aug. 25, 2011

(30) Foreign Application Priority Data

Oct. 27, 2006 (DE) ..... 10 2006 050 757

(51) Int. Cl.
*E04B 2/42* (2006.01)
*E04B 2/44* (2006.01)
*E04B 2/02* (2006.01)

(52) U.S. Cl.
CPC ..... *E04B 2/42* (2013.01); *E04B 2/44* (2013.01); *E04B 2002/0217* (2013.01)

(58) Field of Classification Search
CPC ..... E04B 2/42; E04B 2/44; E04B 2002/0217
USPC ..... 52/503, 223.7, 439, 286, 606, 592.6
See application file for complete search history.

(56) References Cited

U.S. PATENT DOCUMENTS

| | | | | |
|---|---|---|---|---|
| 510,720 | A | 12/1893 | Stewart | |
| 2,684,589 | A * | 7/1954 | Perreton | 52/591.2 |
| 3,256,657 | A * | 6/1966 | Phipps | 52/223.7 |
| 3,888,060 | A * | 6/1975 | Haener | 52/284 |
| 4,627,209 | A * | 12/1986 | Schwartz | 52/591.1 |
| 4,640,071 | A * | 2/1987 | Haener | 52/286 |
| 4,787,189 | A * | 11/1988 | Haug et al. | 52/415 |
| 4,854,103 | A * | 8/1989 | Klym | 52/592.6 |
| 5,230,194 | A * | 7/1993 | McClure | 52/591.4 |
| 5,291,711 | A | 3/1994 | Kopaz | |
| 5,350,256 | A | 9/1994 | Hammer | |
| 5,588,269 | A * | 12/1996 | Wagner | 52/270 |
| 5,701,710 | A | 12/1997 | Tremelling | |
| 5,845,448 | A | 12/1998 | Potvin | |
| 6,122,880 | A * | 9/2000 | Kolb et al. | 52/592.6 |
| 6,412,245 | B1 * | 7/2002 | Lane et al. | 52/586.1 |
| 6,907,704 | B2 * | 6/2005 | Abang Ali et al. | 52/605 |
| 6,978,581 | B1 | 12/2005 | Spakousky | |
| 7,410,328 | B2 | 8/2008 | Hamel | |
| 7,509,779 | B2 | 3/2009 | Makovich | |
| 8,171,688 | B2 * | 5/2012 | Junker | 52/426 |
| 2005/0252134 | A1 * | 11/2005 | Makovich | 52/503 |
| 2006/0070327 | A1 * | 4/2006 | Robinson | 52/503 |
| 2007/0107364 | A1 * | 5/2007 | Estes et al. | 52/606 |
| 2007/0266656 | A1 * | 11/2007 | Blocken | 52/286 |

FOREIGN PATENT DOCUMENTS

| | | |
|---|---|---|
| DE | 18 66 872 | 2/1963 |
| DE | 21 10 061 | 11/1972 |
| DE | 75 35 563 | 4/1976 |
| DE | 77 32 881 | 5/1978 |
| DE | 10224903 | 6/2004 |
| FR | 57 709 | 5/1953 |

* cited by examiner

*Primary Examiner* — Babajide Demuren
(74) *Attorney, Agent, or Firm* — Amy Allen Hinson; Nexsen Pruet, LLC

(57) ABSTRACT

A masonry system having masonry elements which can be laid one on top of the other. Each masonry element has at least one spacer to which two panels are fastened.

22 Claims, 1 Drawing Sheet

MASONRY SYSTEM

CROSS-REFERENCE TO RELATED APPLICATIONS

This application is a divisional application of U.S. patent application Ser. No. 11/874,602 filed Oct. 18, 2007 which is incorporated herein by reference.

BACKGROUND OF THE INVENTION

The invention relates to a masonry system having masonry elements of various sizes and formats upon which masonry element can be laid. Structural units for such a masonry system, in particular for dry masonry walls, are known from European patent EP 0 490 168 B 1. The structural units comprise elements similar to hollow blocks having a frame-like elevation on the surface so that a joint is produced when structural units are laid thereover. The structural units have through openings into which concrete, reinforced with steel bars as appropriate, can be poured in order to achieve greater strength of the masonry system. Such structural units have one or two faces, which correspond to the concrete texture or must be treated in order to create a special texture. A colored building blocks can be produced; however, the costs therefore are relatively high because the building blocks must be manufactured with the decorative mix throughout. From German patent DE 20 2005 017 511 U1 it is further known to use structural units corresponding to the previously cited European patent and to clad the face of such units with at least one surface piece so that a texture becomes visible. Here again the building blocks are massive and heavy and retain the concrete texture apart from the surface piece.

SUMMARY OF THE INVENTION

It is an object of the invention to furnish a masonry system having masonry elements, which masonry system is completely variable, light in terms of construction, favorable in terms of manufacturing, and can be adapted visually to the most varied circumstances. The object of the invention is achieved in that the masonry elements have at least one spacer and two panels that are fastened to the at least one spacer. In a preferred exemplary embodiment there are two spacers per masonry element with some distance therebetween. In this way a masonry element results that is simple in terms of manufacture and light in weight and can be provided with a variety of panels, which are sought out and selected in accord with the visual or engineering circumstances. The spacer, or spacers, are aligned substantially perpendicular to the masonry system and at an angle to the panels and, in the case of at least two spacers, also parallel to one another. They can have a cross section that is polygonal, rectangular, square, oval or circular. By virtue of this fashioning, the spacers preferably take on the actual load-bearing function of the masonry system, the spacing of the spacers relative to one another and to the edges of the panels producing cavities that can likewise be filled with concrete, with reinforced concrete as appropriate, in order to increase the strength of the masonry system. The spacer, or spacer, and the panels are advantageously bonded to one another either in positive fashion, for example with hooks or a dovetail connection, or in nonpositive fashion with adhesive agent, binding agent, adhesive compound binding compound or combinations thereof. The agents or compounds can be fast-curing or slow-curing materials on the one hand and also, on the other, thin liquid and/or thick liquid substances including for example, adhesives, mortars and also foam such as plastic foam. The panels and/or spacers can have grooves or projections in the region of their contact faces in order to improve positioning relative to one another and the adhesion of the adhesive, binding agent and/or binding compound. The agent or compound can also extend into the grooves. The panels and/or spacers can, however, also exhibit recesses substantially corresponding to the width of the contact surfaces between the panels and the spacers, which recesses are preferably fashioned in trough form. In this way alignment and guidance are imparted to the spacer, or spacers, and the panels relative to one another even before fastening. The recesses can be fashioned to correspond to the cross-sectional shape of the spacers and of the panels and form polygonal, rectangular, oval or round sections as viewed in cross section.

There can be troughs in the panels and/or spacers, which troughs are filled with a slower-curing agent or compound, while a fast-curing agent or compound is applied on adjacent surfaces on which the fixation between spacers and panels takes place. Instead of fixation with fast-curing agent or compound, the panels and spacers can also be held in shape relative to one another by an apparatus until the slower-curing agent or compound takes over the bonding function. Next to the adjacent surfaces there can be elevations on one side or both sides serving to align the spacer, or spacers, and panels. These can be individual elevations, for example two, one some distance behind the other, or also strip like elevations. The agents or compounds curing at their various rates are not restricted to the previously described fashioning of the panels with troughs, surfaces and elevations but can be employed with all fashioning of panels and spacers. In order to achieve a face joint between the masonry elements in the masonry system, it is proposed to dispose the spacer, or spacers, so as to protrude past at least one edge of the panels. In this way, when corresponding masonry elements are bonded together, a spacing results between the panels so that a face joint/shadow-casting joint is obtained because the spacers can govern the spacing between the panels. The end faces of the spacers can be fastened together in positive fashion, as previously described in reference to the panels and spacers, or also in nonpositive fashion in correspondence with the agents and/or compounds explained, so that filling of the cavities with concrete can be omitted. The protrusions of the spacers can be applied to both sides or just one side relative to the panel edges. Depending on the excess height of the spacers, the panels can also serve to guide the spacers. This can be utilized for guidance in a masonry system both with and without face joints. In order to avoid the escape and/or efflorescence of the concrete poured into the cavities, there is at least one seal, which is fashioned in strip shape and disposed between the edges of two panels, preferably next to the protrusion of the spacer or spacers. In this way it is ensured that no concrete or concrete liquid can escape into the visible region upon filling. Depending on the fashioning of the masonry system, for example in the case of a freestanding wall, it is desirable that there be two corresponding seals disposed on both sides of the spacer or spacers between the edges of the panels. The seal can also, however, be fashioned in ring form or with corners, lie on the edges of the panels and surround the spacer or spacers. There can also be vertically aligned seals between the end edges of the panels because concrete is also poured between the spacers of two masonry elements as appropriate. The seal can be fastened to a panel before or during the assembly of the masonry system. In order that the seals can be more easily fastened or placed, the horizontal and vertical seals can be assembled in L, T or U shape. There can also be multiple shapes or ring shapes derived therefrom. Such shapes can also be glued to the panels or glued together on a case-by-case basis when the masonry system is assembled. Because the spacers are not optically visible after the completion of the masonry system, they can be fabricated from concrete or from a quite simple, low-cost concrete mix. The panels, or one of the panels, can also be fabricated from simple, low-cost concrete, in particular when these panels are no longer visible after the completion of the masonry system.

The panels can also be variously colored or differently treated or provided with various surface coatings on the faces and can have a layer of face concrete. The layer of face concrete can be treated or visually fashioned in such a way that it corresponds to the desired look of the masonry system. It can be variously textured or variously colored; it can also exhibit patterns due to different coloring and texturing procedures and the like. They can be fabricated by grinding, blasting, brushing and wiping in the still wet or also in the cured condition. The layer of face concrete can exhibit a surface modification, for example with finishes containing acrylate, paint or the like, as protection against moisture, to reduce or prevent dirt absorption and to intensify the color and enhance the color fastness, and also as protection against erosion and weathering. The finishing agent also serves to improve or facilitate cleaning of the surfaces. The panels can also be fabricated from natural stone whose surfaces can be correspondingly modified and/or finished.

As a method for fabricating masonry elements, a panel can be disposed on a substrate, the face of the panel lying downwardly on the substrate. Adhesive agent and/or binding agent and/or adhesive compound and/or binding compound is applied to the panel or to the faces of all spacers facing toward the panels. The spacer or spacers are then laid on the panel. Since the masonry elements have two panels, adhesive agent and/or binding agent and/or adhesive compound and/or binding compound is applied in corresponding fashion to the surface of each spacers facing away from the first panel or to the inside of the second panel, and the second panel is attached. In order in particular to fabricate masonry elements with great dimensional accuracy, the second panel can be pressed against the first panel until the adhesive action of the adhesive agent and/or binding agent and/or adhesive compound and/or binding compound has taken effect. Depending on the size of the panels and spacers, their weight can suffice as compressive load. The compressing mechanism can ensure an exact spacing between the panels, for example by impacts. As already described, however, fast-curing and slower-curing agents or compound can also be employed, the fast curer taking over the fixation function so that the panels can very quickly exit the fabricating apparatus. The apparatus for the method can also have struts or strips to ensure exact guidance of all spacers relative to the panels and between the spacers, in particular when the spacers do not make positive contact with the panels. The method hereinbefore described can also be performed with an apparatus in which the panels and spacers are not disposed lying one over another but in which the panels and spacers are rotated through an angle of 90 degrees and stand next to one another in parallel fashion. They are then fastened together horizontally. This last described procedure permits slower-curing agents and/or compounds to be poured vertically into the recesses, grooves or the like.

BRIEF DESCRIPTION OF THE DRAWINGS

Exemplary embodiments of the invention are shown in the accompanying drawings, in which.

DETAILED DESCRIPTION OF THE INVENTION

Figure 1:
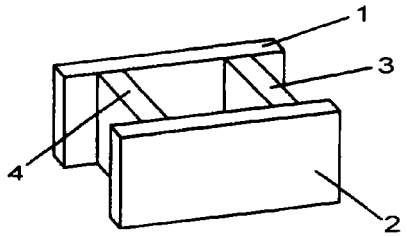
FIG. 1 is a perspective view of a masonry unit having two panels and two spacers.

In FIGS. 1 to 7, insofar as illustrated individually, reference character 1 identifies a first panel and 2 a second panel. Between the parallel panels 1 and 2 there are two parallel spacers 3 and 4. In the exemplary embodiments of FIGS. 1 to 4, the spacers 3, 4 are fashioned in substantially the shape of a rectangular prism. Panels 1 and 2 are fastened to spacers 3 and 4 by an adhesive agent and/or a binding agent and/or an adhesive compound and/or a binding compound, so that a rigid unitary masonry element is produced.

Figure 2:
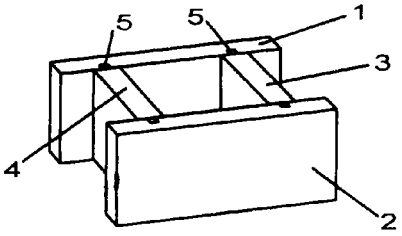
FIG. 2 shows a masonry unit similar to that of FIG. 1 having modified panels.
Figure 5:
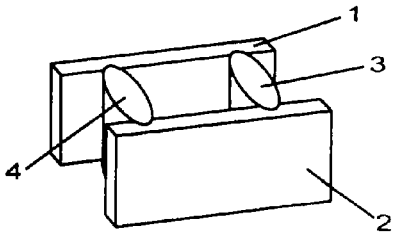
FIG. 5 is a perspective view of a masonry unit having oval section spacers.
Figure 3:
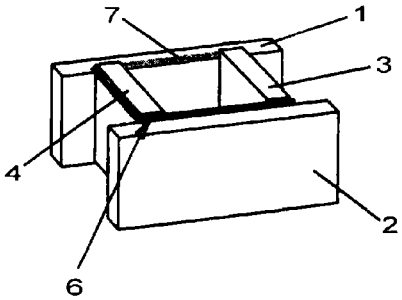
FIG. 3 shows an embodiment similar to that of FIG. 1.

In the exemplary embodiment of FIG. 2 the panels 1, 2 have grooves 5 on their confronting sides facing toward the spacers, into which grooves an adhesive agent and/or a binding agent and/or an adhesive compound and/or a binding component can be placed prior to the spacers being installed. Panels 1 and 2 can, however, also have recesses 6 as illustrated in FIG. 3, wherein the width of the recesses correspond to the width of the spacers received therein, so that fixation of the spacers 3, 4 and the panels 1, 2 relative to one another can be effected before the adhesive agent and/or binding agent and/or adhesive compound and/or binding compound has cured and improved bonding of the spacers 3, 4 and panels 1, 2 to one another takes place. As shown in FIG. 3 there is a seal 7 around the spacers 3, 4 which rests on the edges of the panels 1 and 2 and has a rectangular shape either by primary shaping or by stress.

Figure 4:
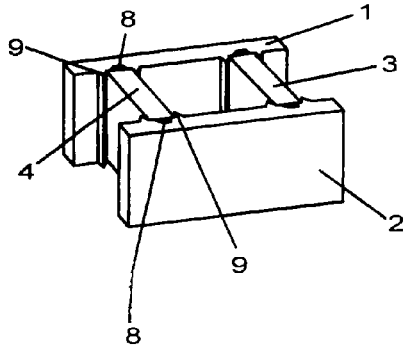
FIG. 4 is a perspective view of a masonry unit similar to that of FIG. 1 with modifications.
Figure 6:
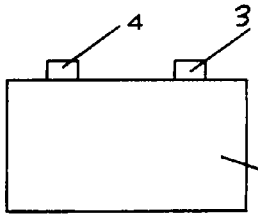
FIG. 6 is a lateral view of a masonry unit with upwardly protruding spacers.

Panels 1 and 2 of FIG. 4 each have two vertically extending troughs 8, smooth surfaces adjacent thereto, and a pair of vertically extending ridges 9 at laterally opposite sides of each trough 8. The troughs 8 serve to accommodate slower-curing agents or compounds, while fast curers are applied to the smooth surfaces, for example as glue dots, in order to ensure fixation. The parallel ridges 9 serve to align the spacers and panels relative to one another. Instead of the fast curers, an apparatus can also fix the panels 1, 2 and spacers 3, 4 relative to one another. In the exemplary embodiment of FIG. 5, the spacers 3 and 4 are fashioned in oval shape. They correspond with recesses in the panels whose cross sections form arcuate sections. Prefixation and enhanced strength also result with these spacers and corresponding recesses in the panels. The exemplary embodiment of FIG. 6 shows spacers 3 having upper ends which 4, protrude above the top of the panels so as to position the masonry elements relative to one another. To this end it is sufficient that the spacers protrude past panel 1 or panels 1 and 2 on one side, it being unimportant whether spacers 3 and 4 are flush or shorter on the opposite, invisible side, because positioning is effected by the protrusions of the spacers with the insides of the panels.

Figure 7:
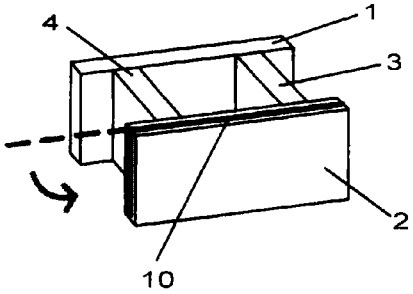
FIG. 7 is a perspective view of a masonry unit similar to that of FIG. 1.

In the exemplary embodiment of FIG. 7, an L-shaped seal 10 is disposed on the top and one side of panel 2 so that, given an appropriate disposition of L-shaped seals on adjacent masonry elements, the masonry system is completely sealed. The arms of the L shaped seal 10 are connected together at a notch in a corner of the panel 2 so that the arms can be aligned straight relative to one another and thus in space-saving fashion for storage and transportation/shipping purposes, as indicated by the dash line. If a masonry system having face joints/shadow-casting joints is to be fabricated, however, the lower or upper end faces of spacers 3 and 4 should be flush with panels 1 and 2 or protruding slightly so that these end faces of the spacers rest at heights adapted to spacers having protrusions or panel edges and define a face joint. There too, appropriately adapted seals can be employed.

What is claimed is:

1. A wall system having wall elements of various sizes and formats on which the wall elements are arranged thereabove can be laid, wherein the wall elements have two spaced-apart spacer bodies per wall element and two panels, wherein the spacer bodies and the panels are connected together by means of adhesives or binders, characterized in that the spacer bodies are configured in a cuboidal manner and are oriented perpendicularly to the wall system, in that the spacer bodies are arranged in a manner protruding over at least one edge of the panels in such a way that the panels are spaced apart when corresponding wall elements are joined onto one another, and in that at least one seal is provided and is arranged between edges of the panel that are arranged one above the other and is formed in a strip-like manner.

2. The wall system of claim 1 wherein the adhesive or binder is quick setting.

3. The wall system of claim 1 wherein the adhesive or binder has means for permanent fastening.

4. The wall system of claim 1 wherein cross section of the spacer bodies is configured in a rectangular manner.

5. The wall system of claim 1 wherein the plates or the spacer bodies have grooves or protrusions in the region of their contact faces.

6. The wall system of claim 1 wherein the plates have clearances corresponding to the width of the contact faces between the plates and spacer bodies, said clearances preferably being configured in the form of a trough.

7. The wall system of claim 6 wherein the clearances are configured in a manner corresponding to the cross-sectional form of the spacer bodies and form rectangular or oval portions as seen in cross section.

8. The wall system of claim 1 wherein the plates have at least one trough and at least one elevation which are arranged in a manner spaced apart from the edge of the trough.

9. The wall system of claim 1 wherein at least one seal is provided, and is arranged between edges of the panels that are arranged alongside one another and is formed in a strip-like manner.

10. The wall system of claim 1 wherein at least one horizontally oriented seal and one vertically oriented seal are connected to form an L-, T-, or U-shaped seal or corresponding polygonal seals or annular seals.

11. The wall system of claim 1 wherein two seals are provided on both sides of the spacer bodies in the region of the two panels.

12. The wall system of claim 1 wherein at least one seal is configured in an annular or angular manner, rests on the edges of the panels and engages around the spacer bodies at their protrusions.

13. The wall system of claim 1 wherein the spacer bodies are made of concrete.

14. The wall system of claim 1 wherein the panels are made of one or more layers of concrete.

15. The wall system of claim 1 wherein the visible faces of the panels have differently coloured facing concrete layers or facing concrete layers provided with different surface layers or surface treatments.

16. The wall system of claim 1 wherein the panels are made of natural stone.

17. The wall system of claim 1 wherein the surfaces of the concrete panels in the fresh or cured state or the surfaces of the natural-stone panels are treated with a finishing agent, selected from the group consisting of acrylates and varnishes.

18. A method for producing wall elements of a wall system of claim 1 wherein a plate is arranged on a substrate, in that adhesives or binders are applied to the plate or to that face of the spacer bodies that faces the plate in that the spacer bodies are joined to the plate such that the spacer bodies are arranged in a manner protruding over at least one edge of the plates in that adhesive or binder is applied in a corresponding manner to that face of the spacer bodies that faces away from the first plate or to the inner side of the second plate and in that the second plate is attached.

19. The method according to claim 18 wherein the plates and the spacer bodies are produced in a device rotated through an angle of 90 degrees to form wall elements.

20. The method according to claim 18 wherein the spacer bodies on the first plate or the second plate is pressed against the first plate by its own weight or by means of pressing force until the adhesive effect of the adhesive or binder has been achieved.

21. The method according to claim 18 wherein a quick-curing adhesive or binder is applied between the spacer bodies and the first plate and/or the second plate preferably at a plurality of points and in that furthermore slow-curing adhesive, mortar or foam is applied between the spacer bodies and plates.

22. The method according to claim 18 wherein the spacer bodies, the first plate and the second plate are held in form on one another by means of fast-setting adhesive or binder or a holding means, and in that adhesive, mortar or foam is applied in the grooves or clearances or next to the protrusions or at the transition regions between the plates and spacer bodies.

* * * * *